US006886903B2

(12) United States Patent
Koehler et al.

(10) Patent No.: US 6,886,903 B2
(45) Date of Patent: May 3, 2005

(54) DETERMINATION OF TURN-ON ENERGY FOR A PRINTHEAD

(75) Inventors: Duane Koehler, Vancouver, WA (US); Volker Smektala, Camas, WA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/603,701

(22) Filed: Jun. 25, 2003

(65) Prior Publication Data

US 2004/0263548 A1 Dec. 30, 2004

(51) Int. Cl.[7] ..... B41J 29/393
(52) U.S. Cl. ..... 347/19
(58) Field of Search ..... 347/5, 9–10, 19, 347/57, 14, 26, 56, 61, 62, 253

(56) References Cited

U.S. PATENT DOCUMENTS 5,428,376 A * 6/1995 Wade et al. ..... 347/14
5,526,027 A 6/1996 Wade et al. ..... 347/14
6,244,682 B1 6/2001 Walker et al. ..... 347/19
6,318,838 B1 11/2001 Anderson et al. ..... 347/36
6,474,772 B1 11/2002 Kawamura et al. ..... 347/19
2003/0058332 A1 * 3/2003 Fujiwara ..... 347/253

* cited by examiner

*Primary Examiner*—Hai Pham

(57) ABSTRACT

The turn-on energy of a printhead is determined. The printhead is fired at a first firing frequency over an initial range of print energies to detect an approximate range of print energies in which the turn-on energy is located. The printhead is fired at a second firing frequency over the approximate range of print energies in which the turn-on energy is located in order to determine a value for the turn-on energy of the printhead. The second firing frequency is higher than the first firing frequency.

49 Claims, 5 Drawing Sheets

DETERMINATION OF TURN-ON ENERGY FOR A PRINTHEAD

BACKGROUND

Inkjet printing mechanisms use moveable cartridges, also called pens, that use one or more printheads formed with very small orifices (also called nozzles) through which drops of liquid ink (i.e., dissolved colorants or pigments dispersed in a solvent) are fired. To print an image, the carriage traverses over the surface of the print medium, and the ink ejection elements associated with the nozzles are controlled to eject drops of ink at appropriate times pursuant to command of a microcomputer or other controller. The pattern of pixels on the print media resulting from the firing of ink drops results in the printed image.

In thermal inkjet printing, electrical resistance heating is used to vaporize ink. The vaporized ink produces a bubble that acts as a piston to expel ink through an orifice in the inkjet pen toward the print medium. Each orifice is associated with an electrical heating resistor. When an electrical heating resistor is electrically energized, ink droplets are vaporized and ejected from an ink chamber associated with the resistor and orifice. A microprocessor selects the appropriate resistors to be fired and directs an electrical current thereto to achieve resistive heating and consequential ejection of ink through the orifice associated with the selected resistor.

In order to determine the optimal firing energy for an inkjet printhead, the printer executes a thermal turn-on energy (TTOE) test. During the test the printhead is fired over a range of print energies while simultaneously monitoring the printhead temperature. The optimal firing energy has been empirically determined to be the printhead's turn-on energy (TOE) plus a fixed percentage (over-energy) to provide margin. Although the best way to determine the TOE is by measuring drop weights, it can be approximated by measuring the temperature of the printhead silicon while firing multiple drops from the printhead. The printhead is fired at discrete steps of firing energy, and the temperature is measured at each step. In this way, the relationship between firing energy and printhead temperature is determined. The thermal TOE is considered to occur when the printhead temperature as a function of firing energy is at or near a local minimum. See, for example, U.S. Pat. No. 6,474,772 B1 issued to Kawamura et al. for a "Method of Determining Thermal Turn on Energy".

For example, the test determines TOE by holding the firing voltage constant, while firing the printhead for a sustained period and monitoring the printhead temperature. This process begins with a high value for the firing pulse width, and then is repeated for progressively smaller pulse width values. When the test detects that the local temperature minimum has been reached, the pulse width value is saved and noted as the "turn on energy" of that particular inkjet printhead.

SUMMARY OF THE INVENTION

In accordance with the preferred embodiment of the present invention, the turn-on energy of a printhead is determined. The printhead is fired at a first firing frequency over an initial range of print energies to detect an approximate range of print energies in which the turn-on energy is located. The printhead is fired at a second firing frequency over the approximate range of print energies in which the turn-on energy is located in order to determine a value for the turn-on energy of the printhead. The second firing frequency is higher than the first firing frequency.

DESCRIPTION OF THE PREFERRED EMBODIMENT

Figure 1:
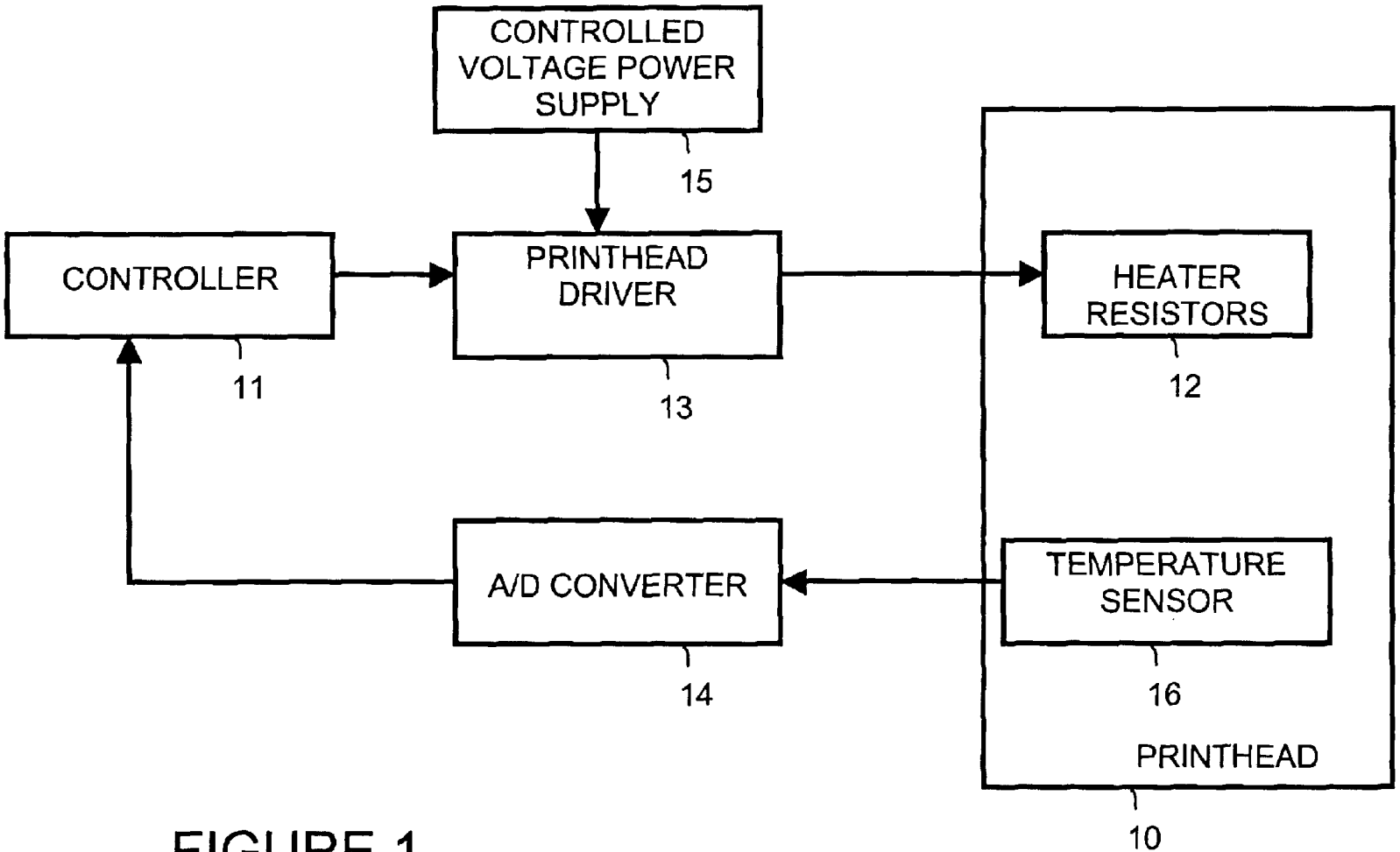
FIG. 1 is a simplified block diagram of portions of a printing device that are used for performing a TTOE test in accordance with a preferred embodiment of the present invention.

FIG. 1 is a simplified block diagram of portions of a printing device that are used for performing a TTOE test. A controller 11 receives print data input and processes the print data. The resulting print control information is forwarded to a printhead driver 13. A controlled voltage power supply 15 provides a controlled supply voltage to printhead driver 13. The magnitude of the supply voltage is controlled, for example, by controller 11. Alternatively, the magnitude of the supply voltage can be fixed.

Printhead driver 13, as controlled by controller 11, applies driving or energizing voltage pulses of voltage to heater resisters 12 located on a printhead 10. Heater resisters 12 are used for fluid ejection. For example, heater resistors 12 are within a thin film integrated circuit thermal ink jet printhead. The voltage pulses supplied to heater resisters 12 are typically applied to contact pads that are connected by conductive traces to heater resistors 12, and therefore the pulse voltage received by heater resisters 12 is typically less than the pulse voltage at the printhead contact pads. Since the actual voltage across heater resistors 12 cannot be readily measured, turn on energy for heater resistors 12 are measured at the contact pads of the printhead cartridge associated with the heater resistors 12. The resistance associated with a heater resistor is expressed herein in terms of pad to pad resistance (i.e., the resistance between the printhead contact pads associated with a heater resistor).

Controller 11 includes, for example, a microprocessor architecture in accordance with known controller structures. Controller 11 provides pulse width and pulse frequency parameters to printhead driver 13. Printhead driver 13 produces drive voltage pulses of width and frequency as selected by controller 11. Controller 11 controls the pulse width and frequency of the voltage pulses applied by printhead driver 13 to heater resistors 12. Additionally, controller 11 may control the voltage of the pulses that are applied by printhead driver 13 to heater resistors 12.

A temperature sensor 16, located on printhead 10, includes, for example, a thermal sensing resistor located in proximity to heater resistors 12. Temperature sensor 16 provides an analog electrical signal representative of the temperature of printhead 10. The analog output of the temperature sensor 16 is provided to an analog-to-digital (A/D) converter 14 which provides a digital output to controller 11. The output of A/D converter 14 is thus directly indicative of the temperature detected by temperature sensor 16.

In order to determine the optimal firing energy for inkjet printhead 10, controller 11 executes a thermal turn-on energy (TTOE) test. During the test, printhead 10 is fired over a range of print energies while controller 11, through A/D converter 14 and temperature sensor 16, simultaneously monitors the temperature of heater resisters 12.

For example, the controller 11 determines turn on energy (TOE) by having printhead driver 13 hold the firing voltage constant, while firing printhead 10 for a sustained period and monitoring temperature of printhead 10. This process begins, for example, with a high value for the firing pulse width, and then is repeated for progressively smaller pulse width values. When a local temperature minimum has been reached, controller 11 saves the pulse width value and uses this to calculate the "turn on energy" of inkjet printhead 10. The process is repeated for all printheads of the printer. Turn-on energy (E) is calculated from printhead voltage (V), resistance across the printhead contact pads (R) and pulse width, in accordance the Equation 1 below:

$$E=(V^2/R)*PW \qquad \text{Equation 1}$$

Figure 2:
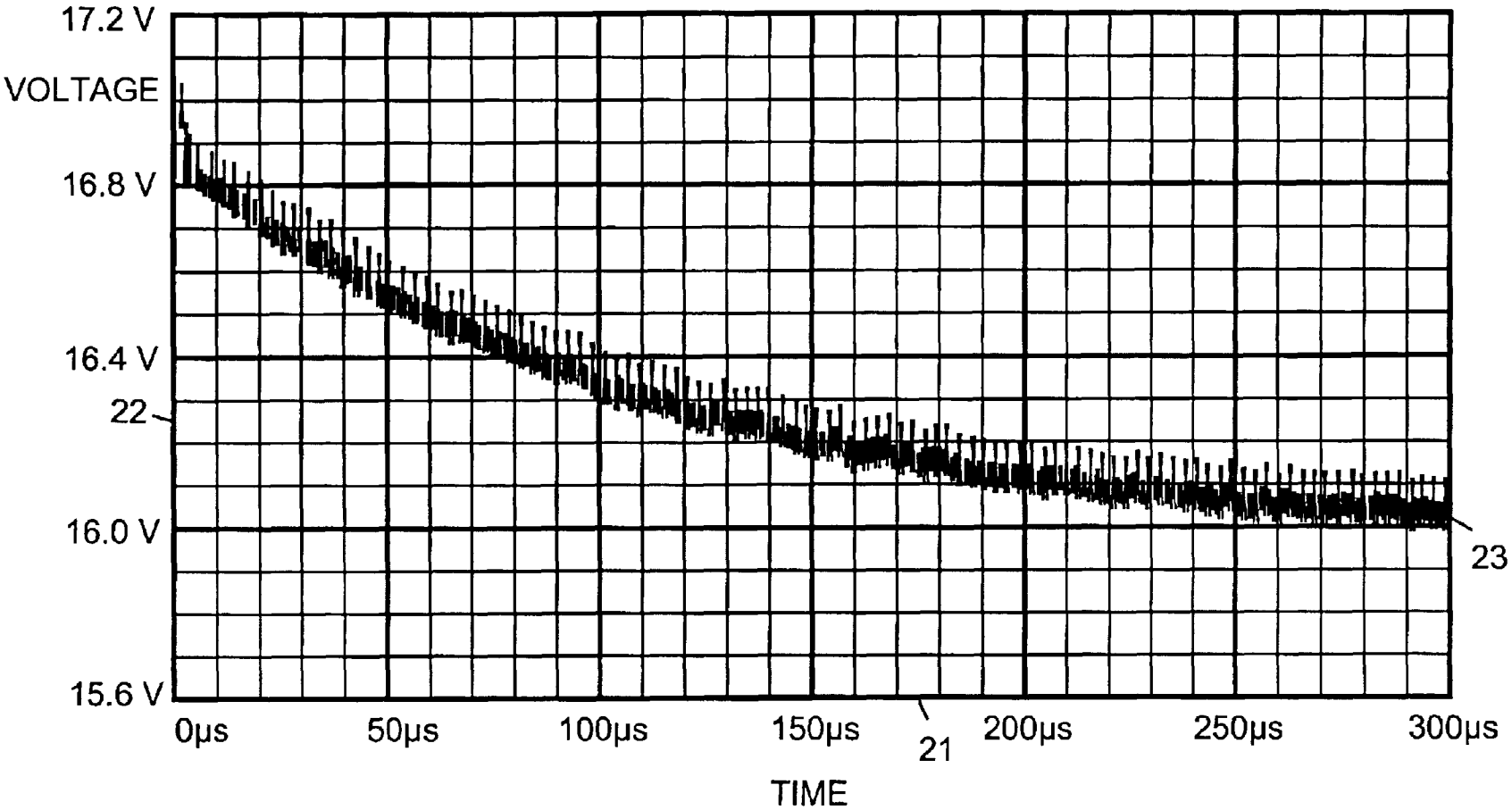
FIG. 2 illustrates printhead voltage droop during dense or fast (21.5 kilohertz) printing.

During printing, the firing voltage of printhead 10 is heavily loaded and droops proportionally. FIG. 2 illustrates printhead voltage droop during dense (21.5 kilohertz) printing. A vertical axis 22 indicates printhead voltage across the printhead contact pads. A horizontal axis 21 represents time. Trace 23, shows printhead voltage droop during dense printing.

Figure 3:
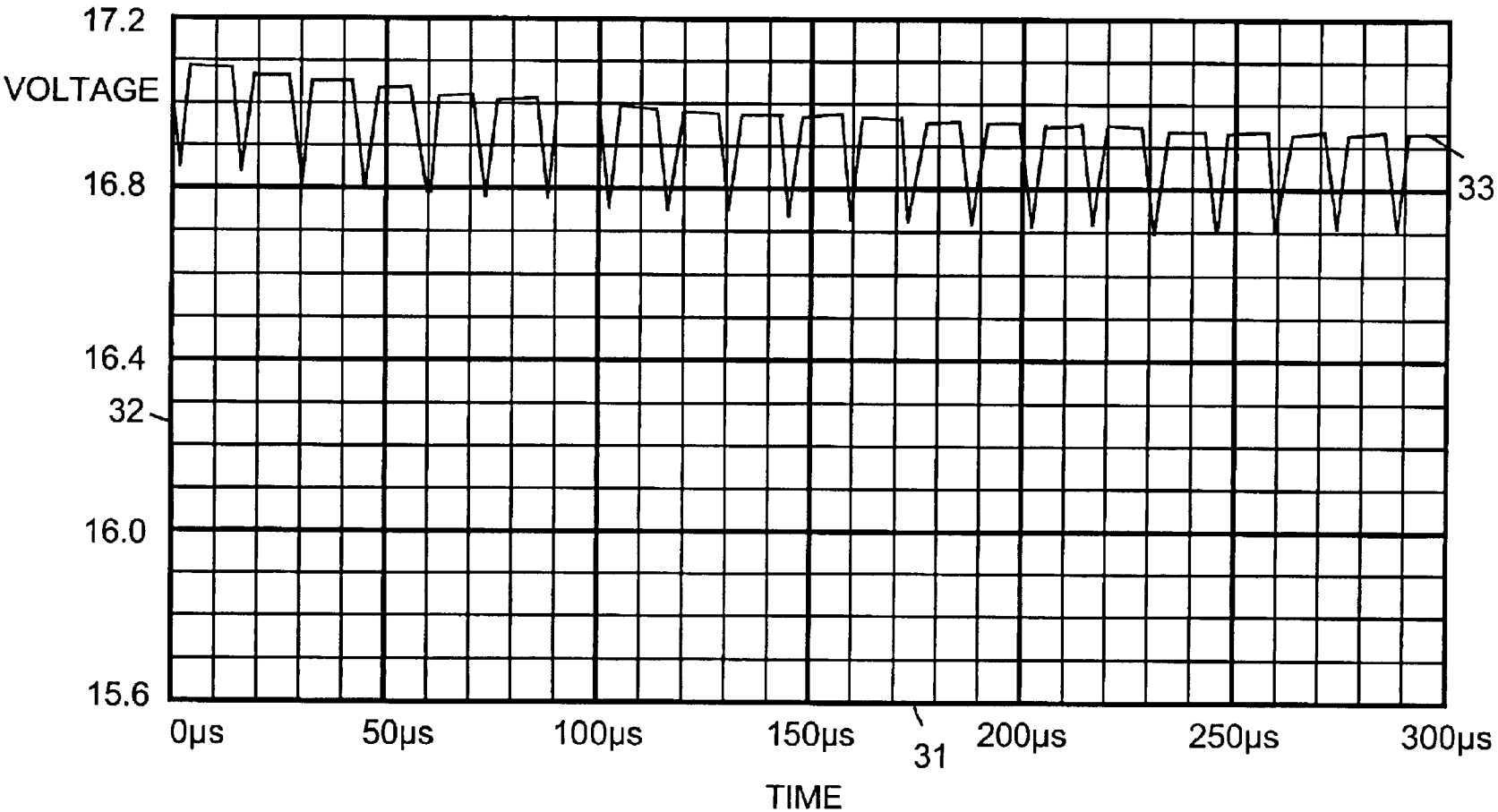
FIG. 3 illustrates printhead voltage droop during sparse or slow (5 kilohertz) printing.

FIG. 3 illustrates printhead voltage droop during sparse (5 kilohertz) printing. A vertical axis 32 indicates printhead voltage across the printhead contact pads. A horizontal axis 31 represents time. Trace 33, shows printhead voltage droop during sparse printing.

As can be seen by comparing FIG. 2 with FIG. 3, there is significantly less voltage droop during sparse (low duty cycle) printing as compared with dense printing.

During dense (fast) printing, as illustrated by FIG. 2, the firing voltage at printhead 10 droops to approximately 16.0V. The firing voltage shown in FIG. 2 is not an absolute value, but is shown for illustrative purposes, to demonstrate the relative difference when compared to sparse (slow) printing. During sparse printing, as illustrated by FIG. 3, the firing voltage at printhead 10 droops to approximately 16.7V.

As seen from Equation 1 above, for a given energy (TOE), the pulse width error during TTOE is proportional to the square of the voltage difference. In this case, the 5% voltage difference will result in a pulse-width error of approximately 10%. This error term is typically higher in printers where controlled voltage power supply 15 is an external power adapter. This is due to the higher impedance differential between a local bulk capacitor's effective series resistance (ESR) and a remote power supply's output and interconnect impedance.

A TTOE test is typically only executed when a new pen is installed in the printer. But because of the many firing cycles required, a significant amount of aerosol can be generated, which is cosmetically objectionable. To minimize the delay for the user to print their first job after installing a new pen, it is advantageous to run the TTOE test as fast for each printhead as possible by increasing the fire frequency. But in order to minimize aerosol generation, it is advantageous to run TTOE more slowly by lowering the fire frequency. In a preferred embodiment of the present invention, a dual-speed micro-stepping TTOE test is used to achieve an accurate TOE determination, with less delay to the user, while still limiting the aerosol generation.

Figure 4:
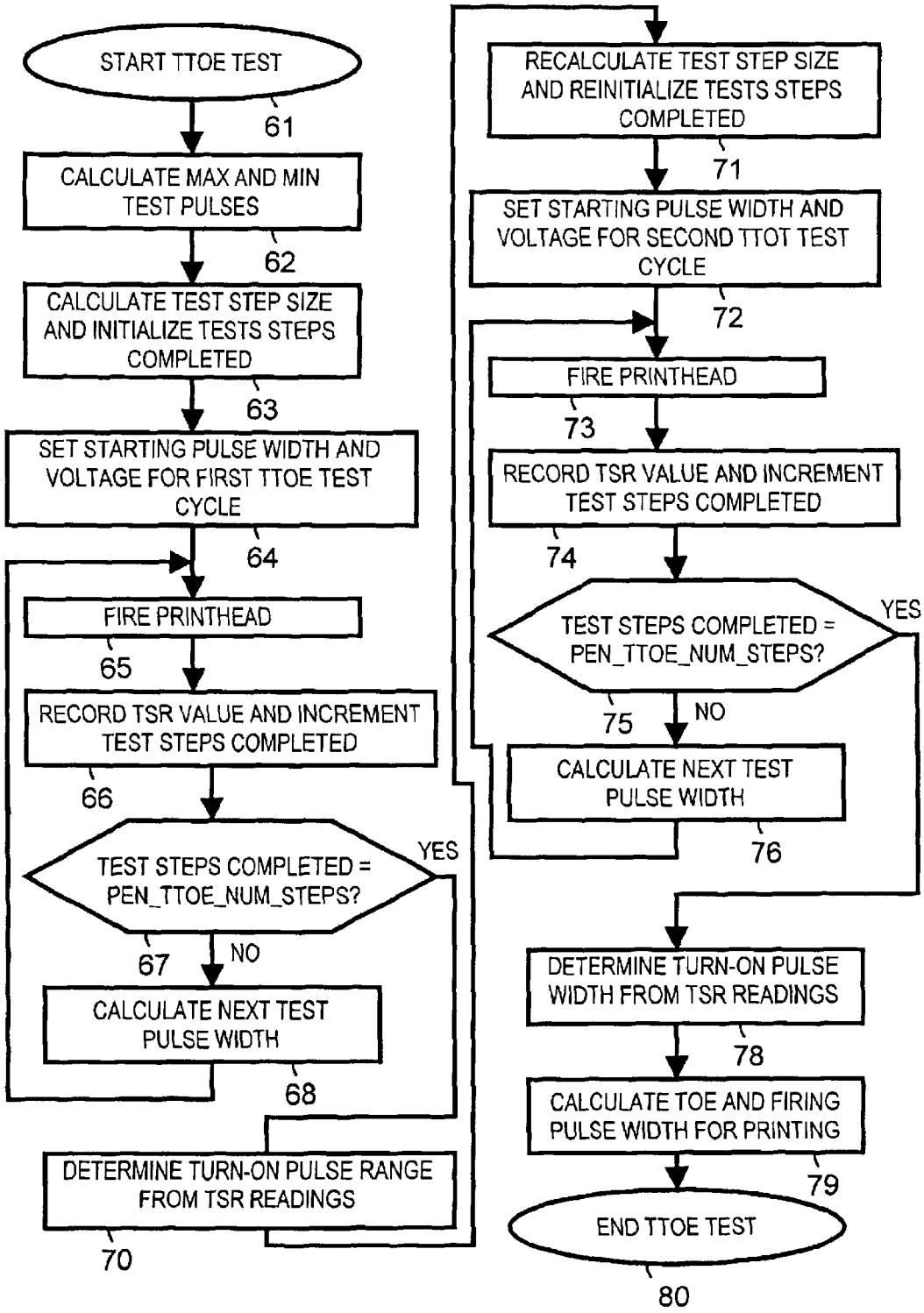
FIG. 4 is a flow chart illustrating a dual speed microstepping TTOE test in accordance with a preferred embodiment of the present invention.

FIG. 4 is a flow chart illustrating a dual speed micro-stepping TTOE test. In a block 61, the TTOE test is started. In a block 62, the maximum and minimum test pulse widths are determined. These values are based on empirically measured data about particular pen and printer specifications.

In a block 63, the test step size is calculated. PEN_TTOE_NUM_STEPS is set to indicate the number of test steps to be performed between the maximum and minimum test pulse widths. For example, for a pulse width range between the maximum and minimum test pulse widths of approximately 840 nanoseconds (ns), PEN_TTOE_NUM_STEPS is set at 10 so that the pulse width is decremented by about 84 ns per firing cycle. In block 62 a variable representing the number of test steps completed is also initialized.

In a block 64, the starting pulse width and voltage are set. In a block 65, the printhead is fired. To reduce aerosol, the printhead is fired at a reduced frequency of, for example, 4.5 Khz. In a block 66, temperature sensor reading (TSR) is taken and recorded. Additionally, the variable representing the number of test steps completed is incremented.

In a block 67, a check is made to see whether the variable representing the number of test steps completed is equal to PEN_TTOE_NUM_STEPS. If not, in a block 68, the next pulse width is calculated. Then, in block 65 the printhead is fired again.

If in block 67, the variable representing the number of test steps completed is equal to PEN_TTOE_NUM_STEPS, in a block 70, a new turn-on pulse width range is determined from the recorded TSR values. This new turn-on pulse width range covers an approximation of the area TOE occurs, as can be determined from the recorded TSR values.

In a block 71, the test step size is recalculated. PEN_TTOE_NUM_STEPS is set to indicate the number of test steps to be performed within the new more narrow turn-on pulse width range. For example, the new pulse width range may be a pulse width range of 126 nanoseconds. For example, PEN_TTOE_NUM_STEPS is set at 3 so that the pulse width is decremented by about 42 ns per firing cycle. In block 71, the variable representing the number of test steps completed is also reinitialized.

In a block 72, the starting pulse width and voltage are set. In a block 73, the printhead is fired. The printhead is fired at an increased frequency of, for example, 21.5 Khz. Because of the reduced number of TTOE test steps run at this higher frequency, the amount of aerosol generated is generally still tolerable. In a block 74, temperature sensor reading (TSR) is taken and recorded. Additionally, the variable representing the number of test steps completed is incremented.

In a block 75, a check is made to see whether the variable representing the number of test steps completed is equal to PEN_TTOE_NUM_STEPS. If not, in a block 76, the next pulse width is calculated. Then, in block 73 the printhead is fired again.

If in block 75, the variable representing the number of test steps completed is equal to PEN_TTOE_NUM_STEPS, in a block 78, the turn-on pulse width is determined from the recorded TSR values. In a step 79, the TOE is calculated from the turn-on pulse width as set out in Equation 1 above. The pulse width used for printing is determined based on TOE.

Figure 5:
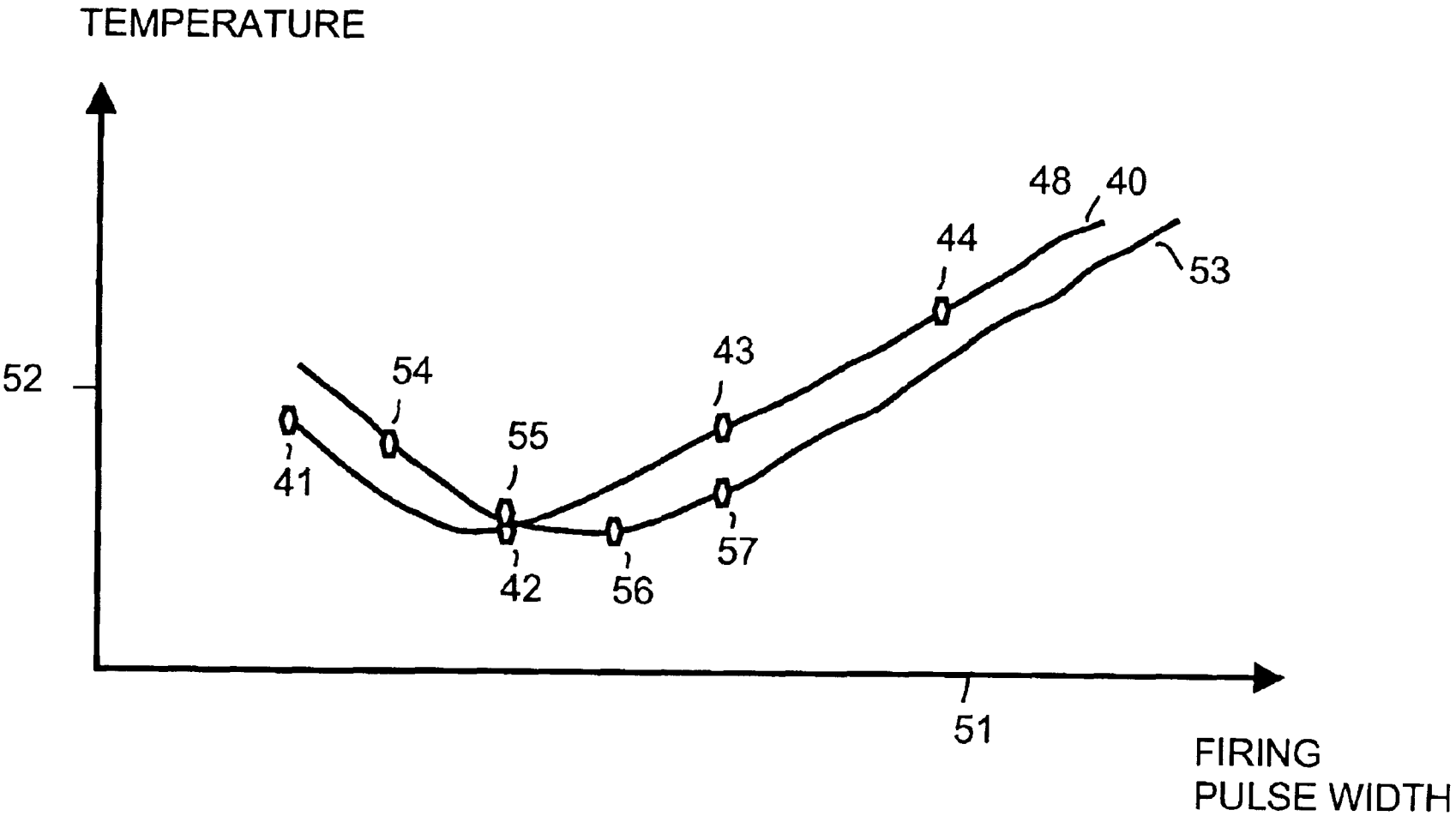
FIG. 5 is a graph that illustrates a dual speed microstepping TTOE test in accordance with a preferred embodiment of the present invention.

FIG. 5 is a graph that illustrates the dual speed micro-stepping TTOE test described above. A vertical axis 52 indicates temperature. A horizontal axis 51 represents firing pulse width. A recorded TSR value 41, a recorded TSR value 42, a recorded TSR value 43, a recorded TSR value 44 are a portion of the recorded TSR values obtained at the reduced frequency of 4.5 KHz. These recorded TSR values are used, in block, 70, to determine the new turn-on pulse width range. This is done, for example, by fitting a trace 40 to the recorded TSR values to find an approximate minimum TSR value.

A recorded TSR value 54, a recorded TSR value 55, a recorded TSR value 56 and a recorded TSR value 57 are the recorded TSR values obtained at the increased frequency of 21.5 KHz. These recorded TSR values are used in block 78 (shown in FIG. 4) to determine the turn-on pulse width. This is done, for example, by fitting a trace 50 to the TSR values recorded in the second TTOE test cycle, in order to find a minimum TSR value for the printhead.

The second TTOE test cycle only has to be run over a narrow range of pulse widths, which is determined to be less than the firing pulse width for recorded TSR value 43 and greater than the firing pulse width for recorded TSR 41. This is because the approximate minimum determined by the first TTOE test cycle lies within that range from the firing pulse width for recorded TSR value 41 to the firing pulse width for recorded TSR value 43.

Also, the ratio of step sizes between the first and second TTOE test cycles can be set to any arbitrary ratio. The example shown uses a ratio of 2:1. Also, more than two TTOE test cycles can be used to further increase the precision of the final result. For example, the multiple TTOE test cycles can use increasingly smaller granularity of pulse width step sizes.

The foregoing discussion discloses and describes merely exemplary methods and embodiments of the present invention. As will be understood by those familiar with the art, the invention may be embodied in other specific forms without departing from the spirit or essential characteristics thereof. Accordingly, the disclosure is intended to be illustrative, but not limiting, of the scope of the invention, which is set forth in the following claims.

We claim:

1. A method for determining a turn-on energy of a printhead comprising:

firing the printhead at a first firing frequency over an initial range of print energies to detect an approximate range of print energies in which the turn-on energy is located; and, firing the printhead at a second firing frequency over the approximate range of print energies in which the turn-on energy is located in order to determine a value for the turn-on energy of the printhead, wherein the second firing frequency is higher than the first firing frequency.

2. A method as in claim 1 wherein the second firing frequency is more than twice the first firing frequency.

3. A method as in claim 1 wherein:

firing the printhead at the first firing frequency over the initial range of print energies comprises passing a first plurality of substantially constant voltage electric signals through heater resistors within the printhead and varying a pulse width of the first plurality of substantially constant voltage electric signals within a first range of pulse widths; and firing the printhead at the second firing frequency over the approximate range of print energies in which the turn-on energy is located comprises passing a second plurality of substantially constant voltage electric signals through the heater resistors and varying a pulse width of the second plurality of substantially constant voltage electric signals within a second range of pulse widths narrower than the first range of pulse widths.

4. A method as in claim 3 wherein:

varying the pulse width of the first plurality of substantially constant voltage electric signals comprises reducing a pulse width of each successive signal in the first plurality of substantially constant voltage electric signals; and, varying the pulse width of the second plurality of substantially constant voltage electric signals comprises reducing a pulse width of each successive signal in the second plurality of substantially constant voltage electric signals.

5. A method as in claim 3 wherein:

varying the pulse width of the first plurality of substantially constant voltage electric signals comprises reducing a pulse width of each successive signal in the first plurality of substantially constant voltage electric signals by a first amount;

varying the pulse width of the second plurality of substantially constant voltage electric signals comprises reducing a pulse width of each successive signal in the second plurality of substantially constant voltage electric signals by a second amount; and, the second amount is smaller than the first amount.

6. A method as in claim 1 wherein:

when firing the printhead at the first firing frequency, different print energies are obtained by varying pulse width of an electric signal passed through heater resistors within the printhead; and, when firing the printhead at the second firing frequency, different print energies are obtained by varying pulse width of an electric signal passed through heater resistors within the printhead.

7. A method as in claim 1 additionally comprising:

firing ink at additional print frequencies in order to more accurately determine the value for the turn-on energy of the printhead.

8. A method as in claim 1 wherein the approximate range of print energies in which the turn-on energy is located is detected by monitoring temperature of the printhead in order to approximate a range of pulse widths where a minimum temperature of the printhead occurs.

9. A method as in claim 1 wherein the value for the turn-on energy is determined by monitoring temperature of the printhead in order to determine a pulse width where a minimum temperature of the printhead occurs.

10. A method for determining a turn-on energy of a printhead comprising:

firing the printhead at a first firing frequency over an initial range of print energies to detect an approximate range of print energies in which the turn-on energy is located, including:

passing a first plurality of substantially constant voltage electric signals through heater resistors within the printhead and reducing a pulse width of each successive signal in the first plurality of substantially constant voltage electric signals by a first amount; and, firing the printhead at a second firing frequency over the approximate range of print energies in which the turn-on energy is located in order to determine a value for the turn-on energy of the printhead, including:

passing a second plurality of substantially constant voltage electric signals through the heater resistors and reducing a pulse width of each successive signal in the second plurality of substantially constant voltage electric signals by a second amount;

wherein the second firing frequency is higher than the first firing frequency.

11. A method as in claim 10 wherein the second firing frequency is more than twice the first firing frequency.

12. A method as in claim 10 additionally comprising:

firing ink at additional print frequencies in order to more accurately determine the value for the turn-on energy of the printhead.

13. A method as in claim 10 wherein the second amount is smaller than the first amount.

14. A method as in claim 10, wherein the approximate range of print energies in which the turn-on energy is located is detected by monitoring temperature of the printhead in order to approximate a range of pulse widths where a minimum temperature of the printhead occurs.

15. A method as in claim 10, wherein the value for the turn-on energy is determined by monitoring temperature of the printhead in order to determine a pulse width where a minimum temperature of the printhead occurs.

16. A device comprising:

a printhead used to eject ink; and, a controller that controls ejection of ink from the printhead, wherein the controller determines a turn-on energy of the printhead by causing the printhead to fire ink at a first firing frequency over an initial range of print energies to detect an approximate range of print energies in which the turn-on energy is located, and by causing the printhead to fire ink at a second firing frequency over the approximate range of print energies in which the turn-on energy is located in order to determine a value for the turn-on energy of the printhead, wherein the second firing frequency is higher than the first firing frequency.

17. A device as in claim 16 wherein the printhead includes a temperature sensor used to detect approximate temperature of the printhead.

18. A device as in claim 16 wherein the second firing frequency is more than twice the first firing frequency.

19. A device as in claim 16 wherein when the printhead fires at the first firing frequency, different print energies are obtained by varying pulse width of an electric signal passed through heater resistors within the printhead.

20. A device as in claim 16 wherein when the printhead fires at the second firing frequency, different print energies are obtained by varying pulse width of an electric signal passed through heater resistors within the printhead.

21. A device as in claim 16:

wherein when the printhead fires at the first firing frequency, different print energies are obtained by the printhead fires using a first plurality of pulse widths of an electric signal passed through heater resistors within the printhead;

wherein when the printhead fires at the second firing frequency, different print energies are obtained by the printhead fires using a second plurality of pulse widths of the electric signal passed through heater resistors within the printhead; and, wherein the second plurality of pulse widths are spaced closer together than the first plurality of pulse widths.

22. A device as in claim 16, wherein the device is a printer.

23. A device as in claim 16, wherein the device is used within a printer.

24. A device as in claim 16 wherein the controller causes the printhead to fire ink at additional print frequencies in order to more accurately determine the value for the turn-on energy of the printhead.

25. A device as in claim 16 wherein the approximate range of print energies in which the turn-on energy is located is detected by monitoring temperature of the printhead in order to approximate a range of pulse widths where a minimum temperature of the printhead occurs.

26. A device as in claim 16 wherein the value for the turn-on energy is determined by monitoring temperature of the printhead in order to determine a pulse width where a minimum temperature of the printhead occurs.

27. A device comprising:

a printhead used to eject ink; and, a controller that controls ejection of ink from the printhead, wherein the controller determines a turn-on energy of the printhead by causing the printhead to fire ink at a first firing frequency over an initial range of print energies to detect an approximate range of print energies in which the turn-on energy is located, including passing a first plurality of substantially constant voltage electric signals through heater resistors within the printhead and reducing a pulse width of each successive signal in the first plurality of substantially constant voltage electric signals, and by causing the printhead to fire ink at a second firing frequency over the approximate range of print energies in which the turn-on energy is located in order to determine a value for the turn-on energy of the printhead, including passing a second plurality of substantially constant voltage electric signals through the heater resistors and reducing a pulse width of each successive signal in the second plurality of substantially constant voltage electric signals by a second amount;

wherein the second firing frequency is higher than the first firing frequency.

28. A device as in claim 27 wherein the printhead includes a temperature sensor used to detect approximate temperature of the printhead.

29. A device as in claim 27 wherein the second firing frequency is more than twice the first firing frequency.

30. A device as in claim 27, wherein the second amount is smaller than the first amount.

31. A device as in claim 27, wherein the device is a printer.

32. A device as in claim 27, wherein the device is used within a printer.

33. A device as in claim 27 wherein the controller causes the printhead to fire ink at additional print frequencies in order to more accurately determine the value for the turn-on energy of the printhead.

34. A device as in claim 27, wherein the approximate range of print energies in which the turn-on energy is located is detected by monitoring temperature of the printhead in order to approximate a range of pulse widths where a minimum temperature of the printhead occurs.

35. A device as in claim 27, wherein the value for the turn-on energy is determined by monitoring temperature of the printhead in order to determine a pulse width where a minimum temperature of the printhead occurs.

36. A device comprising:

means for ejecting ink; and, means for controlling the ejection of ink, wherein the means for controlling the ejection of ink determines a turn-on energy of the means for ejecting ink by causing the means for ejecting ink to fire ink at a first firing frequency over an initial range of print energies to detect an approximate range of print energies in which the turn-on energy is located, and by causing the means for ejecting ink to fire ink at a second firing frequency over the approximate range of print energies in which the turn-on energy is located in order to determine a value for the turn-on energy of the means for ejecting ink, wherein the second firing frequency is higher than the first firing frequency.

37. Storage media that stores programming which when executed on a printing device, performs a method for determining turn-on energy of a printhead, the method comprising:

firing the printhead at a first firing frequency over an initial range of print energies to detect an approximate range of print energies in which the turn-on energy is located; and, firing the printhead at a second firing frequency over the approximate range of print energies in which the turn-on energy is located in order to determine a value for the turn-on energy of the printhead, wherein the second firing frequency is higher than the first firing frequency.

38. Storage media as in claim 37 wherein the second firing frequency is more than twice the first firing frequency.

39. Storage media as in claim 37 wherein:

firing the printhead at the first firing frequency over the initial range of print energies comprises passing a first plurality of substantially constant voltage electric signals through heater resistors within the printhead and varying a pulse width of the first plurality of substantially constant voltage electric signals within a first range of pulse widths; and firing the printhead at the second firing frequency over the approximate range of print energies in which the turn-on energy is located comprises passing a second plurality of substantially constant voltage electric signals through the heater resistors and varying a pulse width of the second plurality of substantially constant voltage electric signals within a second range of pulse widths narrower than the first range of pulse widths.

40. Storage media as in claim 39 wherein:

varying the pulse width of the first plurality of substantially constant voltage electric signals comprises reducing a pulse width of each successive signal in the first plurality of substantially constant voltage electric signals; and, varying the pulse width of the second plurality of substantially constant voltage electric signals comprises reducing a pulse width of each successive signal in the second plurality of substantially constant voltage electric signals.

41. Storage media as in claim 39, wherein:

varying the pulse width of the first plurality of substantially constant voltage electric signals comprises reducing a pulse width of each successive signal in the first plurality of substantially constant voltage electric signals by a first amount;

varying the pulse width of the second plurality of substantially constant voltage electric signals comprises reducing a pulse width of each successive signal in the second plurality of substantially constant voltage electric signals by a second amount; and, the second amount is smaller than the first amount.

42. Storage media as in claim 37, wherein the approximate range of print energies in which the turn-on energy is located is detected by monitoring temperature of the printhead in order to approximate a range of pulse widths where a minimum temperature of the printhead occurs.

43. Storage media as in claim 37, wherein the value for the turn-on energy is determined by monitoring temperature of the printhead in order to determine a pulse width where a minimum temperature of the printhead occurs.

44. Storage media that stores programming which when executed on a printing device, performs a method for determining turn-on energy of a printhead, the method comprising:

firing the printhead at a first firing frequency over an initial range of print energies to detect an approximate range of print energies in which the turn-on energy is located, including:

passing a first plurality of substantially constant voltage electric signals through heater resistors within the printhead and reducing a pulse width of each successive signal in the first plurality of substantially constant voltage electric signals by a first amount; and, firing the printhead at a second firing frequency over the approximate range of print energies in which the turn-on energy is located in order to determine a value for the turn-on energy of the printhead, including:

passing a second plurality of substantially constant voltage electric signals through the heater resistors and reducing a pulse width of each successive signal in the second plurality of substantially constant voltage electric signals by a second amount;

wherein the second firing frequency is higher than the first firing frequency.

45. Storage media as in claim 44 wherein the second firing frequency is more than twice the first firing frequency.

46. Storage media as in claim 45 additionally comprising:

firing ink at additional print frequencies in order to more accurately determine the value for the turn-on energy of the printhead.

47. Storage media as in claim 45 wherein the second amount is smaller than the first amount.

48. Storage media as in claim 44, wherein the approximate range of print energies in which the turn-on energy is located is detected by monitoring temperature of the printhead in order to approximate a range of pulse widths where a minimum temperature of the printhead occurs.

49. Storage media as in claim 44, wherein the value for the turn-on energy is determined by monitoring temperature of the printhead in order to determine a pulse width where a minimum temperature of the printhead occurs.

* * * * *